US006285267B1

(12) United States Patent
Hauth et al.

(10) Patent No.: US 6,285,267 B1
(45) Date of Patent: Sep. 4, 2001

(54) WAVEGUIDE FILTER

(75) Inventors: Wolfgang Hauth, Backnang; Dietmar Schmitt, Kleinaspach, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/486,179

(22) PCT Filed: Jul. 28, 1998

(86) PCT No.: PCT/DE98/02133

§ 371 Date: Jun. 15, 2000

§ 102(e) Date: Jun. 15, 2000

(87) PCT Pub. No.: WO99/10947

PCT Pub. Date: Mar. 4, 1999

(30) Foreign Application Priority Data

Aug. 21, 1997 (DE) ..... 197 36 367

(51) Int. Cl.[7] ..... H01P 1/20
(52) U.S. Cl. ..... 333/210; 333/208; 333/202
(58) Field of Search ..... 333/208, 210, 333/212, 202, 33, 34

(56) References Cited

U.S. PATENT DOCUMENTS 3,271,706 * 9/1966 Rooney ..... 333/210
3,597,710 8/1971 Levy .
3,845,422 * 10/1974 Rhodes ..... 333/73
4,661,999 * 4/1987 Ullmann et al. ..... 333/208
5,142,255 * 8/1992 Chang et al. ..... 333/204
6,169,466 * 1/2001 Goulouev ..... 333/210

FOREIGN PATENT DOCUMENTS 0 274 859 7/1988 (EP) .

OTHER PUBLICATIONS

Hauth et al., "The Corrugated—Waveguide Band—Pass Filter—A New Type of Waveguide Filter," Proceedings of the European Microwave Conference, Folkets Hus, Sweden, Sep. 12–16, 1988, No. Conf. 18, Sep. 12, 1988, pp. 945–949, Microwave Exhibitions and Publishers Ltd., p. 946.
Jones, "Microwave Filters, Impedance—Matching Networks and Coupling Structures," McGraw Hill Book Co., 1964, pp. 358, 393–408.
ANT Nachrichtentechnische Berichte, vol. 5, Nov. 1988, pp. 114–120.

* cited by examiner

*Primary Examiner*—Robert Pascal
*Assistant Examiner*—Patricia T. Nguyen
(74) *Attorney, Agent, or Firm*—Kenyon & Kenyon

(57) ABSTRACT

A waveguide filter having a stepped transformer area on the input and/or output sides, with at least one band-stop filter composed of geometrically closely spaced stop elements integrated into this stepped transformer area. These features make it possible to build waveguide filters with a high edge steepness and a short overall length.

10 Claims, 2 Drawing Sheets

WAVEGUIDE FILTER

BACKGROUND INFORMATION

The present invention relates to a waveguide filter having a stepped transformer area on the input side and/or output side as well as an area of alternate-height waveguide segments.

A waveguide filter of this type is known from "Microwave Filters, Impedance-Matching Networks and Coupling Structures"; Matthaei, Young, Jones; McGraw Hill Book Company 1964, pages 398 to 408, in particular FIG. 7.05–8 on page 405. The area of alternate-height waveguide segments in this filter has a waffle-iron filter structure. On the input and output sides of this structure are located stepped transformers with corrugated areas that each measure $\lambda_g/4$ in length, where λk represents the waveguide wavelength in the pass band.

A waveguide filter with stepped transformers on the input and output sides as well as an intermediate area of coupled resonators in the form of a corrugated waveguide filter (Matthaei, Young, Jones, page 358, paragraph 2) with low-pass action is known from ANT Nachrichtentechnische Berichte, Volume 5, November 1988, pages 114 to 120.

SUMMARY OF THE INVENTION

The waveguide filter makes it possible to build waveguide filters with a high edge steepness and a short overall length.

Waveguide filters with a high edge steepness are generally implemented using conventional corrugated waveguide filter structures. However, this would necessitate a very large number of elements, i.e., a chain of short rectangular waveguide segments with alternating greater and lesser heights, thus requiring a great overall length and mass. The large number of elements would also produce extremely high attenuation in the pass band, making it especially difficult to use the filter in satellites.

Another way to produce high edge steepness is to use additional, relatively narrow-band band-stop filters. Known band-stop waveguide filter designs use stubs that either branch off from the waveguide via a coupled cavity resonator measuring $\lambda_g'/2$ in length (where $\lambda_g'$ is equal to the waveguide wavelength in the pass band of the band-stop filter) or fully coupled stubs that measure $\lambda_g'/4$ in length and are short-circuited on one end (Matthaei, Young, Jones, pages 725 to 768). The distance between the resonators and stubs, respectively, measures unequal multiples of $\lambda_g'/4$. If three filter circuits are used, for example, this would add at least another $\lambda_g'/2$ to the total length of a conventional low-pass filter.

According to the present invention, however, geometrically closely spaced stop elements are used which are additionally integrated into the one or more stepped transformers. These two features provide a stop band with a very high stop-band attenuation directly above the pass band and simultaneously reduce the number of steps needed. This makes it possible, in particular, to build low-pass waveguide filters with a very short overall length.

If the stubs of a band-stop filter have different lengths, the width and depth of the stop band can be flexibly adjusted to the requirements at hand.

Because there is no need for the intermediate lengths measuring $\lambda_g'/4$ between the stop elements or at the end of short-circuited stubs, as is common in known band-stop filter designs, and therefore fewer matching units are also needed, the waveguide filter according to the present invention has a very short overall length. The entire structure can be produced by cost-effective milling techniques and does not require any equalization elements if properly dimensioned.

The filter according to the present invention is especially suitable for suppressing undesired spurious signals in traveling-field tubes of communications satellites because it supplies a high stop-band attenuation both directly above the pass band and at long frequency intervals despite its short overall length.

The area of alternate-height waveguide segments can also be designed as a corrugated waveguide, a ridged waveguide, or a waffle-iron waveguide filter. A waffle-iron filter design has the additional advantage that it enables signal components that are propagated in the form of higher-order waveguide modes to be attenuated on the second and third harmonics.

In communications satellites, interconnected narrow-band channel filters are used to direct the signals on the individual transmission channels to a common bus bar (output multiplexer), from where they are routed to the antenna. However, the traveling-field tubes serving as transmitter amplifiers produce not only the wanted signal but also undesired spurious signals (transmit signal noise, i.e., harmonics), which should be heavily attenuated before reaching the antenna. Because the far-off selectivity of the channel filters is poor, additional low-pass filters are be inserted into the transmission branch. These filters meet especially high stop-band attenuation requirements in the satellite receive bands, e.g., bands II and m at 14 and 18 Ghz, respectively (FIG. 3). In the current satellite generation, band II lies just above transmission band I, where the pass band of the low-pass filter is located. The transition to the stop band therefore requires an extremely high edge steepness. At the same time, however, the filter still have a high stop-band attenuation on the second and third harmonics (bands IV and V) at 24 and 35 Ghz. The filter according to the present invention meets all of these requirements.

Further important properties of a low-pass input filter of this type include its dimensions and mass. The filter according to the present invention provides an optimum compromise between the electrical and mechanical properties (mass, volume).

DETAILED DESCRIPTION

Figure 1:
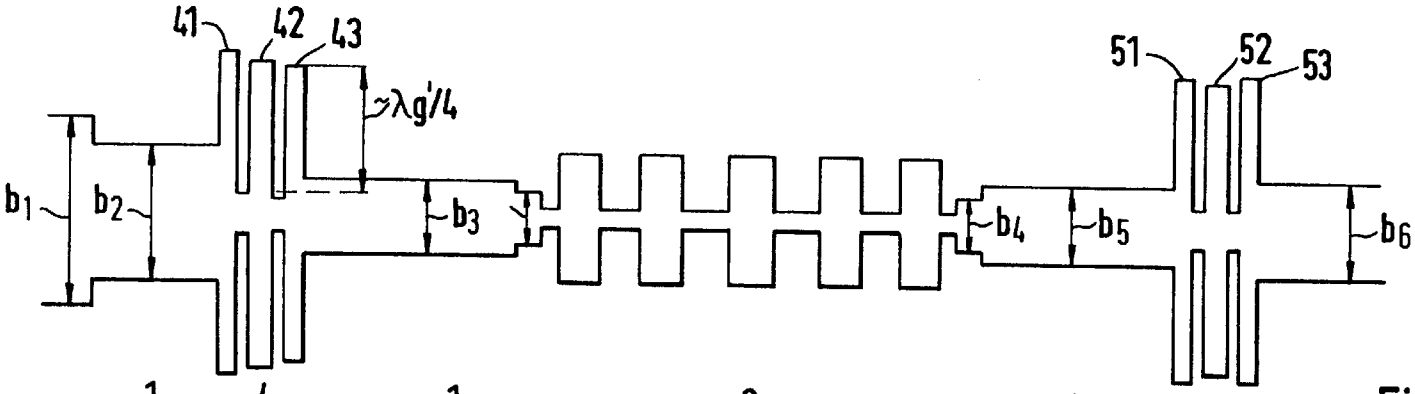
FIG. 1 shows a longitudinal section of a waveguide filter according to the present invention.
Figure 2:
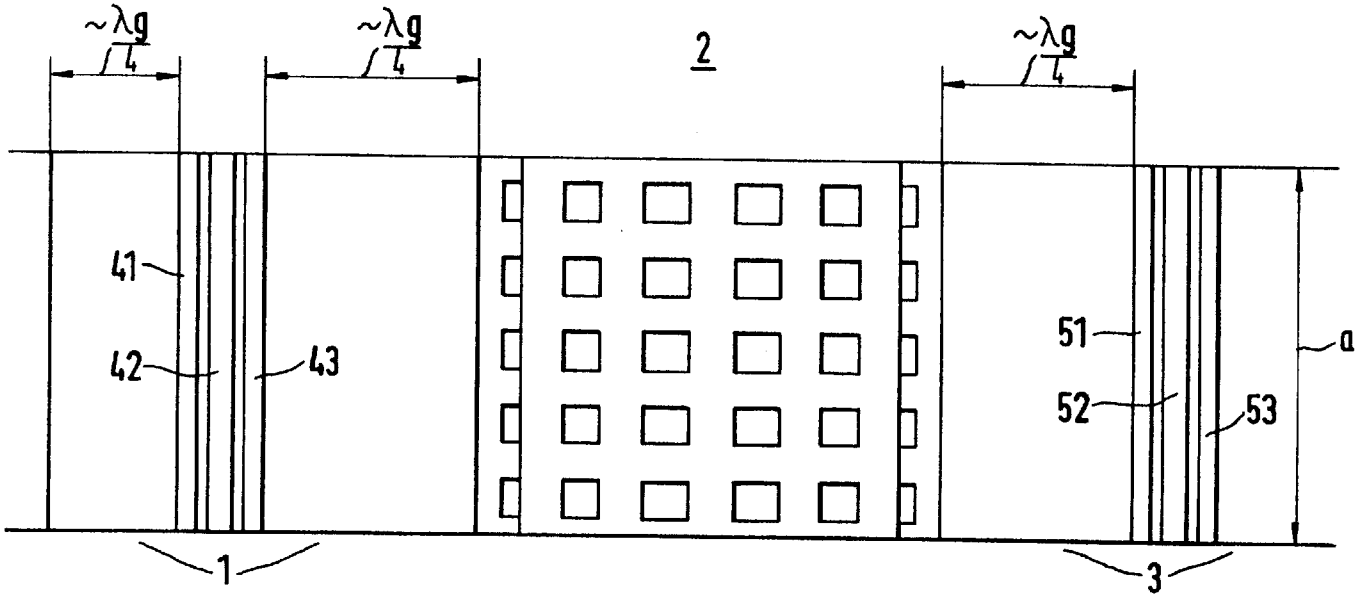
FIG. 2 shows a top view of a waveguide filter according to the present invention.
Figure 3:
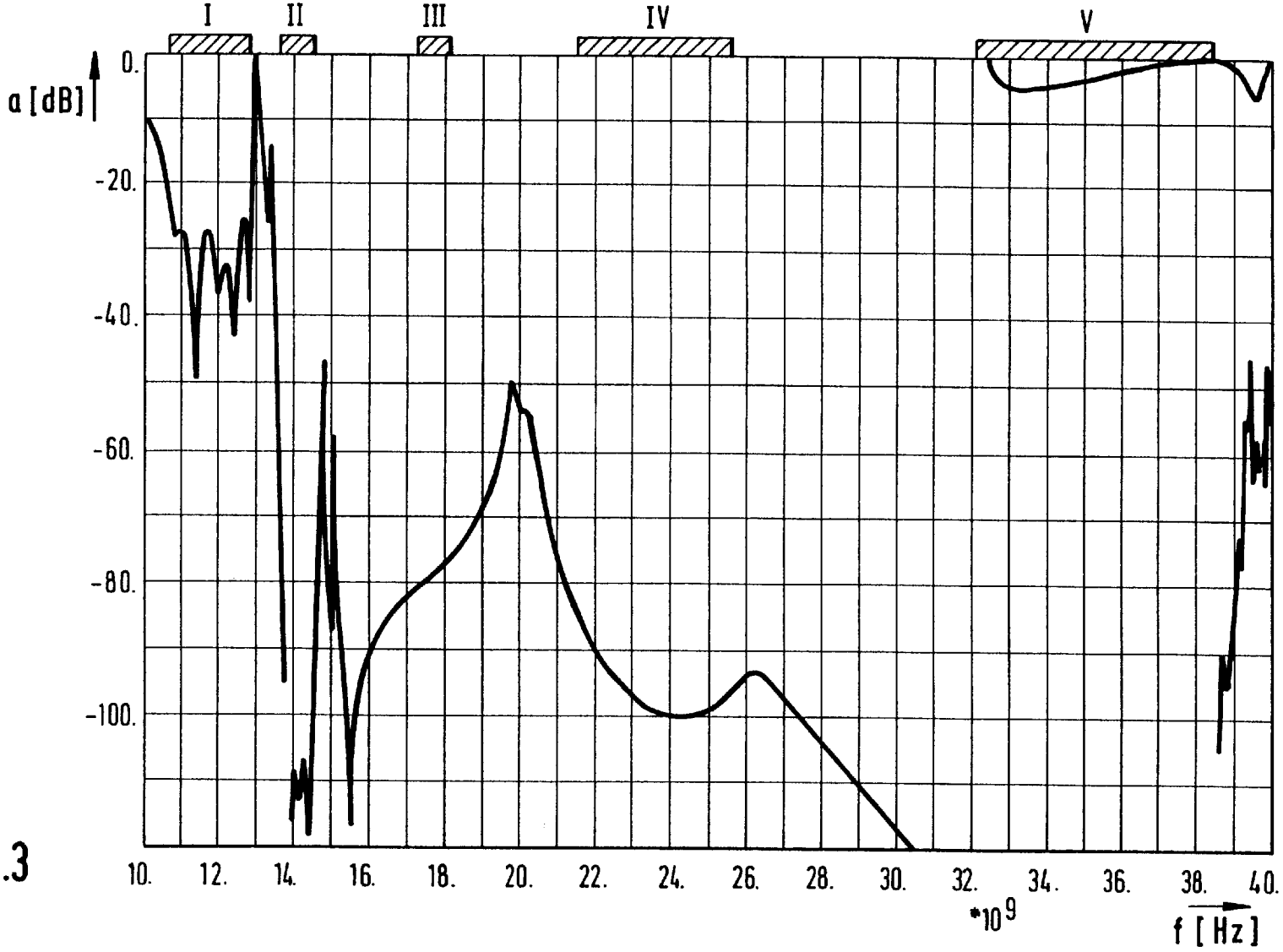
FIG. 3 shows the attenuation and matching curve of a waveguide filter according to the present invention over the frequency.

FIG. 1 shows a longitudinal cross-section of an example of a waveguide filter according to the present invention. It includes a stepped transformer area 1 and 3, respectively, on the input and output sides as well as an intermediate area 2 composed of a chain of short rectangular waveguide segments of alternating lesser and greater heights, with the shorter segments providing a shunt-capacitance action and the higher ones a series-inductance action. Stepped transformer areas 1 and 3 are used to adjust the waveguide to be connected, whose dimensions are designed for the useful band. According to the present invention, stepped transformer areas 1 and 3 each contain a band-stop filter 4 and 5, respectively, which are preferably located at a point of discontinuity of a stepped transformer—in the embodiment, it lies between the waveguide segment of height b2 and waveguide segment b3, and correspondingly between the waveguide segments of heights b5 and b6. A band-stop filter of this type preferably includes geometrically closely spaced stop elements 41, 42, 43 and 51, 52, 53, respectively, in this case in the form of stubs that are short-circuited at on end and measure approximately $\lambda_g'/4$ in length. In this example, geometrically closely spaced means that the usual intermediate lengths of at least $\lambda_g'/4$ are eliminated, i.e., the distance between the stop elements is short compared to $\lambda_g'/4$. In the top view shown in FIG. 2, these stubs appear as ridges extending over the entire width of the waveguide. The low-pass waveguide filter illustrated in FIG. 1 can be an ordinary corrugated filter or preferably a waffle-iron filter (as shown in FIG. 2). The waffle-iron filter has the additional advantage that it allows signal components that are propagated in the form of higher-order waveguide modes to be attenuated in the area of the second and third harmonics (bands IV and V in FIG. 3). Both filter types generally have a low input impedance, i.e., they are designed for connecting cross-section a×b4, with b4 being much shorter than remaining connecting heights b1 and b6, respectively. Depending on the desired pass-bandwidth and cross-sectional ratio, therefore, multiple transformers are usually needed on both sides to match the external cross sections. Integrating a band-stop filter with n (in this case n=3) very closely spaced stubs yields a high pass-bandwidth, if suitably dimensioned, reducing the number of steps and simultaneously providing the necessary high stop-band attenuation directly above the pass band (band II). In the illustrated example, only two steps of heights b2 and b3 are needed for height ratio b1/b4 and only one step of height b5 for height ratio b6/b4. Like ordinary stepped transformers, the steps measure approximately $\lambda_g'/4$ in length, where $\lambda_g$ represents the waveguide wavelength in the pass band. FIG. 3, which shows attenuation and matching curve a over frequency f—together with frequency bands I to V provided for transmission—demonstrates the extremely high edge steepness during the transition from the pass band to the stop band.

To achieve good transmission properties, the stop elements on the input and output sides should each provide a paired symmetrical stop action. However, in the case of variable waveguide heights, as shown in FIG. 1, the stubs have asymmetrical lengths.

A ridged waveguide filter structure can also be provided instead of a corrugated waveguide filter or a waffle-iron filter. The features of the present invention are not limited to the use of rectangular waveguides. Thus, the present invention can also be used for filters having coaxial cables, for example the filter type known from ANT Nachrichtentechnische Berichte, Volume 2, December 1984, pages 36 to 41, in particular FIG. 10.

It is also possible to eliminate the stepped transformer area on the input or output side, in particular if the height of the desired connecting waveguide is equal to the input or output height of area 2.

Of course, it is also possible to provide stop elements at additional points of discontinuity in the one or more stepped transformers 1 and 3, respectively.

Furthermore, the stop elements can have a different design.

What is claimed is:

1. A waveguide filter, comprising:

a stepped transformer area provided on one of an input side and an output side;

an area of alternate-height waveguide segments; and at least one band-stop filter formed as at least two closely spaced stop elements and integrated into the stepped transformer area, wherein a distance by which the at least two closely spaced stop elements are from one another is short compared to one fourth of a waveguide wavelength.

2. The waveguide filter according to claim 1, wherein:

the at least one band-stop filter includes closely spaced stubs that are short-circuited at one end.

3. The waveguide filter according to claim 2, wherein:

the stubs have varying lengths.

4. The waveguide filter according to claim 1, wherein:

the distance between the stop elements is short compared to $\lambda_g/4$, $\lambda_g$ represents the waveguide wavelength in a pass band, and the at least two closely spaced stop elements are provided in the stepped transformer area on both the input side and the output side.

5. The waveguide filter according to claim 2, wherein:

the stubs that are short-circuited at one end measure approximately $\lambda_g'/4$ in length, and $\lambda_g'$ represents the waveguide wavelength in a stop band of the at least one band-stop filter.

6. The waveguide filter according to claim 1, wherein:

the at least two closely spaced stop elements are located on both an input side and an output side of the area of alternate-height waveguide segments, and the at least two closely spaced stop elements are each positioned at a distance of approximately $\lambda_g/4$ from the area of alternate-height waveguide segments.

7. The waveguide filter according to claim 1, wherein:

the area of alternate-height waveguide segments is designed as one of a ridged waveguide filter area and a waffle-iron filter area.

8. The waveguide filter according to claim 7, wherein:

the at least two closely spaced stop elements on an input side and an output side of the at least one band-stop filter each provides a paired symmetrical stop action.

9. The waveguide filter according to claim 1, wherein:

the stepped transformer area corresponds to at least one stepped transformer area, and the at least two closely spaced stop elements of one of the at least one band-stop filter are provided at a point of discontinuity in the at least one stepped transformer area.

10. The waveguide filter according to claim 1, wherein:

the waveguide filter is used as a low-pass filter in a transmission branch of a radio-frequency power amplifier corresponding to a traveling-field amplifier for a satellite, having relatively closely spaced transmit and receive bands.

* * * * *